US011820544B2

(12) United States Patent
Skarsoe et al.

(10) Patent No.: US 11,820,544 B2
(45) Date of Patent: Nov. 21, 2023

(54) APPARATUS FOR EMPTYING A FLEXIBLE LINER

(71) Applicant: TPS RENTAL SYSTEMS LTD., Droitwich (GB)

(72) Inventors: Hans Joergen Skarsoe, Bad Iburg (DE); Klaus-Dieter Walther, Lienen (DE); Jürgen Huneke, Ladbergen (DE)

(73) Assignee: TPS RENTAL SYSTEMS LTD., Droitwich (GB)

( * ) Notice: Subject to any disclaimer, the term of this patent is extended or adjusted under 35 U.S.C. 154(b) by 43 days.

(21) Appl. No.: 17/290,640

(22) PCT Filed: Oct. 17, 2019

(86) PCT No.: PCT/EP2019/078296
§ 371 (c)(1),
(2) Date: Apr. 30, 2021

(87) PCT Pub. No.: WO2020/094361
PCT Pub. Date: May 14, 2020

(65) Prior Publication Data

US 2022/0033126 A1 Feb. 3, 2022

(30) Foreign Application Priority Data

Nov. 8, 2018 (DE) ..... 20 2018 106 355 .3

(51) Int. Cl.
*B65B 69/00* (2006.01)
*B66F 9/02* (2006.01)

(52) U.S. Cl.
CPC ..... *B65B 69/0008* (2013.01); *B65B 69/005* (2013.01); *B66F 9/02* (2013.01)

(58) Field of Classification Search
CPC ..... B65B 69/0008; B65B 69/005; B66F 9/02
See application file for complete search history.

(56) References Cited

U.S. PATENT DOCUMENTS 4,079,860 A * 3/1978 Maves ..... G01F 11/24 384/276
4,627,551 A * 12/1986 Kopp ..... B65D 75/5822 222/102

(Continued)

FOREIGN PATENT DOCUMENTS

CN 104494977 A 4/2015
CN 105329506 A 2/2016

(Continued)

OTHER PUBLICATIONS

International Search Report issued by the European Patent Office dated Jan. 31, 2020 in related patent application PCT/EP2019/078296, official translation provided.

(Continued)

*Primary Examiner* — Andrew M Tecco
*Assistant Examiner* — Nicholas E Igbokwe
(74) *Attorney, Agent, or Firm* — Hassan Abbas Shakir; Shakir Law PLLC

(57) ABSTRACT

An apparatus for emptying a flexible line of a packaging container, having a pulling unit, which has a movable pulling element, onto which a fastening section of the liner can be fasted, wherein the fastening section of the liner can be pulled up and let down by means of the pulling element of the pulling unit, to empty the liner, a stripping device, which comprises one or more stripping bodies, which are set up for stripping a section of the liner so as to empty the liner, and a lifting device, which is set up for moving the stripping device in the vertical direction.

3 Claims, 5 Drawing Sheets

(56) References Cited

U.S. PATENT DOCUMENTS

| | | | | |
|---|---|---|---|---|
| 5,649,801 | A * | 7/1997 | White | B65B 69/0008 414/415 |
| 5,765,723 | A * | 6/1998 | Wilcox | B65D 77/06 222/100 |
| 8,157,127 | B2 * | 4/2012 | Mauger | B67D 7/0244 222/326 |
| 8,590,740 | B2 | 11/2013 | Mauger et al. | |
| 2012/0037657 | A1 * | 2/2012 | Mazzotta | G01F 23/265 222/64 |
| 2014/0217118 | A1 * | 8/2014 | Kuismanen | B67D 7/0216 222/102 |
| 2017/0225882 | A1 * | 8/2017 | Sullinger | B65D 83/0055 |

FOREIGN PATENT DOCUMENTS

| | | | |
|---|---|---|---|
| CN | 107963284 | A | 4/2018 |
| DE | 60 2004 011 209 | T2 | 1/2009 |
| GB | 1587661 | A | 4/1981 |
| WO | 2011080402 | A1 | 7/2011 |

OTHER PUBLICATIONS

Written Opinion of the International Searching Authority issued by the European Patent Office dated Jan. 31, 2020 in related patent application PCT/EP2019/078296, official translation provided.

Search Report issued by the German Patent & Trademark Office dated Mar. 25, 2019 in related patent application DE 20 2018 106 355.3, partial translation provided.

* cited by examiner

APPARATUS FOR EMPTYING A FLEXIBLE LINER

BACKGROUND OF THE INVENTION

1. Field of the Invention

The invention is directed to an apparatus for emptying a flexible liner of a packaging container. More particularly, the invention is directed to an apparatus having a pulling unit that has a movable pulling element, onto which a fastening section of the liner can be fastened, wherein the fastening section of the liner can be pulled up and let down by means of the pulling element of the pulling unit, so as to empty the liner, and having a stripping device that comprises one or more stripping bodies that are set up for stripping a section of the liner so as to empty the liner.

2. Discussion of the Related Art

In a plurality of application areas, it is necessary to supply material capable of flow, in other words fluids having different viscosity, to technical facilities or systems. In the pharmaceutical industry and the foods sector, in particular, fluids that are filled into corresponding packaging containers must regularly be supplied to machines and systems.

In this connection, the fluid to be filled in is usually delivered in a packaging container that comprises an outer container and a flexible liner arranged within the container. The fluid to be filled in is situated within the flexible liner, wherein the liner is protected against damage by the container.

The liner usually has an outlet tap to which a pump device for pumping out the material situated in the liner can be connected. In order for material that can be pumped out to be constantly present in the region of the outlet tap during the emptying process of the liner, emptying apparatuses are used to support feed of the material to be filled in, in the direction of the outlet tap.

In the state of the art, wringer devices that can be driven manually are known, for example, by means of which the flexible liner can be wrung out during the emptying process. This and other solutions are time-consuming and require the deployment of personnel. In the case of highly viscous substances, in particular, a comparatively large amount of material remains in the liner in the case of the known solutions, so that only partial emptying of the liner is implemented. The material that remains in the liner is usually disposed of together with the liner. In the case of expensive materials, in particular, as they are frequently used in the pharmaceutical industry, this results in a significant impairment of the economic efficiency of the corresponding process.

Furthermore, emptying apparatuses are known in the state of the art, with which only liners that have a centrally arranged center outlet can be emptied. In practice, however, liners and containers have become prevalent, which have an outlet tap arranged at the side, so that a great number of known apparatuses cannot be used for emptying corresponding liners.

SUMMARY OF THE INVENTION

The task on which the invention is based therefore consists in increasing the degree of emptying during emptying of flexible liners, and, in this regard, preferably reducing the emptying effort. This is supposed to be implemented, in particular, for containers having a side outlet.

This task is accomplished by means of an apparatus of the type stated initially, wherein the apparatus according to the invention has a lifting device that is set up for moving the stripping device in the vertical direction.

The invention makes use of the recognition that feed of the material situated within the liner, to the outlet tap, can be significantly improved by means of a stripping device that can be moved in the vertical direction, so that the degree of emptying that can be achieved is significantly increased. By means of the combination of the movable pulling element of the pulling unit and the stripping device that can be moved in the vertical direction, the liner can be pulled up and let down several times during emptying, and furthermore can be stripped several times. As the result of such emptying, only a slight residual amount of material remains in the liner after the emptying process has been completed.

Preferably, a material capable of flow, for example a fluid, is stored in the liner to be emptied. The fluid can be a highly viscous fluid, for example. The stripping device is fastened to the lifting device, so that the lifting device can move the stripping device in a vertical direction. By means of the lifting device, the stripping device can be moved upward and downward in the vertical direction. The packaging container can comprise a container, within which the liner to be emptied is arranged. The liner can have an outlet tap, with which a pumping device for pumping out the material contained in the liner can be connected. The outlet tap preferably extends through an outlet opening of the container, wherein the outlet opening of the container is preferably arranged in a lower region of a side wall of the container. The packaging container therefore preferably has a side outlet. The liner can be a film sack or a film bag. The pulling element of the pulling unit can be a pulling cable, for example. The fastening section of the liner, which section can be fastened to the pulling element, preferably comprises an inlet tap of the liner, by way of which the liner was originally filled with the material capable of flow.

In a preferred embodiment of the apparatus according to the invention, the pulling unit has a non-manual drive, by means of which the pulling element can be moved to pull up and let down the fastening section of the liner. The drive of the pulling unit can be a motor drive, a hydraulic drive or a pneumatic drive. The drive of the pulling unit can be a linear drive that comprises one or more hydraulic cylinders, pneumatic cylinders or electric cylinders, for example. Furthermore, the drive of the pulling unit can be an electromechanical linear drive. Furthermore, the pulling unit can have one or more deflection elements, for example deflection rollers, by way of which the pulling element is deflected. As a result, the movement direction of the drive of the pulling unit can be converted for pulling up and letting down the fastening section of the liner.

In another preferred embodiment of the apparatus according to the invention, the lifting device has a non-manual drive, by means of which the stripping device can be moved in the vertical direction. The drive of the lifting unit can be a motor drive, a hydraulic drive or a pneumatic drive. The drive of the lifting device can be a linear drive, which comprises, for example, one or more hydraulic cylinders, pneumatic cylinders or electric cylinders. Furthermore, the drive of the lifting device can be an electromechanical linear drive.

In another embodiment, the apparatus according to the invention has a control device that is set up for controlling the drive of the pulling unit and/or the drive of the lifting device. In particular, the control device is set up for controlling the drive of the pulling unit and the drive of the lifting device independently of one another or adapted to one another. By way of a corresponding controller, the result can be achieved that pulling up and letting down the fastening section of the liner is implemented at the same time as or with a time offset from the vertical movement of the stripping device.

In a further embodiment of the apparatus according to the invention, the control device is set up for controlling the drive of the pulling unit in such a manner that the fastening section of the liner is constantly held under tension during emptying of the liner. Preferably, the pulling force applied to the fastening section of the liner during emptying of the liner is essentially kept constant or kept within an acceptable pulling force range. If the stripping device is automatically moved upward and downward by the lifting device, multiple times, one after the other, during emptying of the liner, the fastening section of the liner is also automatically pulled up and let down multiple times, one after the other, during emptying, so that the pulling force applied to the fastening section of the liner during emptying of the liner is essentially kept constant or within the acceptable pulling force range. Preferably, therefore, multiple movement cycles of the fastening section of the liner occur during emptying of the liner, wherein the fastening section of the liner is both pulled up and let down during a movement cycle. As the result of the multiple pulling up and letting down of the liner, a significant increase in the degree of emptying that can be achieved takes place. Due to the fact that pulling up and letting down take place automatically, the emptying process is significantly simplified.

Furthermore, an apparatus according to the invention is preferred, in which the control device is set up for controlling the drive of the pulling unit in such a manner that pulling up the fastening section of the liner is interrupted during emptying of the liner, if the pulling force exceeds a pulling force limit value. Thereby damage to the liner, which is attributable to the pulling force of the pulling unit, is prevented from taking place. Tearing of the liner while the fastening section of the liner is being pulled up is thereby effectively prevented. Furthermore, the control device is preferably set up for allowing the fastening section of the liner to be let down, so as to prevent the pulling force limit value from being exceeded. If the pulling force applied to the fastening section of the liner is increased during a downward movement of the stripping device, the fastening section of the liner is therefore let down if the pulling force limit value is exceeded, so that the fastening section of the liner follows the stripping device in the vertical direction.

Furthermore, an apparatus according to the invention is preferred, in which the control device is set up for controlling the drive of the lifting device in such a manner that the stripping device is automatically moved upward and downward by the lifting device, during emptying of the liner, preferably multiple times, one after the other. Because the stripping device is automatically moved upward and downward during emptying of the liner, multiple times, one after the other, multiple stripping cycles are implemented during emptying of the liner. Since the fastening section of the liner is also pulled up and let down multiple times during emptying of the liner, different sections of the liner are stripped during emptying, so that the degree of emptying that can be achieved is further increased.

In another embodiment of the apparatus according to the invention, the control device is set up for controlling the drive of the pulling unit and the drive of the lifting device in such a manner that simultaneously pulling up the fastening section of the liner and a downward movement of the stripping device brought about by the lifting device are prevented during emptying of the liner. This is preferably achieved in that the fastening section of the liner is always kept pulled, and letting down the fastening section of the liner is implemented, so as to prevent the pulling force limit value from being exceeded if an increase in pulling force results from the downward movement of the stripping device. Alternatively or in addition, the control device is set up for controlling the drive of the pulling unit and the drive of the lifting device in such a manner that simultaneously letting down the fastening section of the liner and the upward movement of the stripping device brought about by the lifting device is prevented during emptying of the liner. This is preferably achieved in that the fastening section of the liner is always kept pulled, and the pulling force applied to the fastening section of the liner is always kept essentially constant or within an acceptable pulling force ranged during emptying of the liner. Thereby opposite movements of the liner and of the stripping device are essentially prevented. Therefore a pulling unit that is reduced in force can be used, and thereby the risk of damage to the liner during the emptying process is significantly reduced.

In a further embodiment of the apparatus according to the invention, the control device is set up for controlling the drive of the pulling unit and the drive of the lifting device in such a manner that pulling up the fastening section of the liner takes place at the same time with the upward movement of the stripping device brought about by the lifting device, during emptying of the liner. This is preferably achieved in that the fastening section of the liner is always kept pulled, and the pulling force applied to the fastening section of the liner during emptying of the liner is essentially kept constant or within an acceptable pulling force range. Alternatively or in addition, the control device is set up for controlling the drive of the pulling unit and the drive of the lifting device in such a manner that letting down the fastening section of the liner takes place at the same time with the downward movement of the stripping device brought about by the lifting device, during emptying of the liner. This is preferably achieved in that the fastening section of the liner is always kept pulled, and letting down the fastening section of the liner is implemented so as to prevent the pulling force limit value from being exceeded if an increase in pulling force results from the downward movement of the stripping device. The pulling path when pulling up the fastening section of the liner and the lifting path of the upward movement of the stripping device can be different from one another. The release path when letting down the fastening section of the liner and the lifting path of the downward movement of the stripping device can differ from one another.

Furthermore, an apparatus according to the invention is preferred, which has a filling level detection device that is set up for detecting the filling level of the liner during emptying of the liner. By means of detection of the filling level of the liner, pulling up and letting down the fastening section of the liner, adapted to the filling level of the liner, can take place by means of the pulling element of the pulling unit. Furthermore, the stripping device can be controlled as a function of the detected filling level of the liner.

In a particularly preferred embodiment of the apparatus according to the invention, the filling level detection device is fastened to the lifting device. Therefore the lifting device is set up for moving the filling level detection device in the vertical direction. Thereby at least part of the filling level detection device moves in the same manner as the stripping device, which is also fastened to the lifting device. In particular, the filling level detection device can also be fastened to the lifting device by way of the stripping device.

Furthermore, an apparatus according to the invention is advantageous, in which the filling level detection device has a guide that is fastened to the lifting device in locally fixed manner, and a contact device that is guided within the guide and can be moved in the vertical direction, relative to the guide, wherein a contact section of the contact device is set up for coming into contact with the liner during a downward movement of the lifting device, wherein as the result of the contact with the liner and the further downward movement of the lifting device, a relative movement of the contact device and of the guide is brought about. The filling level of the liner can be detected by way of the relative movement of the contact device and of the guide. Preferably one or more sensors is/are arranged on the guide and/or on the contact device, by way of which sensor(s) the path of the relative movement can be detected.

In a further embodiment of the apparatus according to the invention, the control device is set up for controlling the drive of the lifting device as a function of the filling level of the liner detected by the filling level detection device. If the path of the relative movement of the contact device and of the guide reaches a limit value, for example if the contact device reaches a reversal point, preferably the downward movement of the lifting device is interrupted and the upward movement of the lifting device is brought about.

Furthermore, an apparatus according to the invention is advantageous, in which the stripping device has stripping bodies configured as stripping rollers, which have axes of rotation that are essentially parallel. The stripping bodies can be displaceable relative to one another, for example for insertion or positioning of the liner to be emptied. The stripping device can have movable, in particular pivoting brackets. Furthermore, the stripping bodies can be brought into contact with one another. In particular, one stripping body has at least one groove, and another stripping body has at least one material ridge wherein the at least one groove and the at least one material ridge can be brought into contact with one another. If the stripping bodies are configured as stripping rollers, the at least one groove and the at least one material ridge can be circumferential, so that great stability of the stripping bodies is implemented even during the rotational movement. The stripping bodies can make a stripping opening available, through which the liner extends during emptying. By means of displacement of at least one stripping body, the stripping opening can be opened and/or its size can be changed.

In particular, an apparatus according to the invention is preferred, which has a frame structure to which the lifting device together with the stripping device and preferably the filling level detection device, as well as a guide link for the pulling element of the pulling unit are fastened, wherein the frame structure can preferably be displaced in the horizontal direction, relative to a base frame. By means of displacement of the frame structure in the horizontal direction relative to the base frame, the apparatus can be brought into a setup state, in which placement of the liner in the region of the stripping opening and fastening of the fastening section of the liner to the pulling element is simplified. By means of the displacement of the frame structure, the apparatus can then subsequently be moved to a working state. Preferably, the apparatus comprises a non-manual drive for displacement of the frame structure. Furthermore, the base frame and/or the frame structure can be tilted and/or inclined relative to the horizontal. For this purpose, the base frame and/or the frame structure can be coupled with a further drive.

BRIEF DESCRIPTION OF THE DRAWINGS

In the following, preferred embodiments of the invention will be explained and described in greater detail, making reference to the attached drawings. In this regard, the figures show.

DETAILED DESCRIPTION OF THE INVENTION

Figure 1:
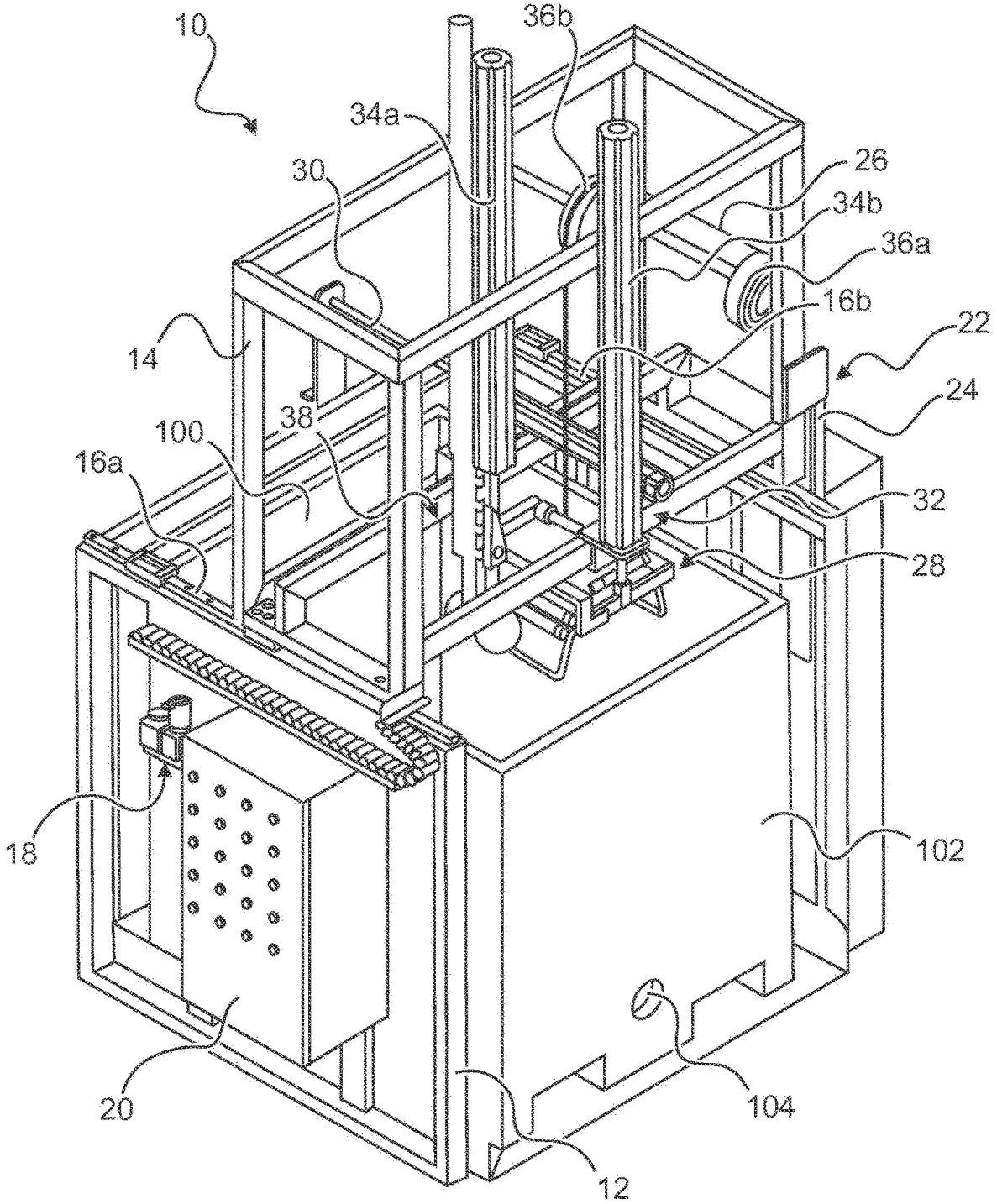
FIG. 1 an exemplary embodiment of the apparatus according to the invention in a perspective representation.
Figure 2:
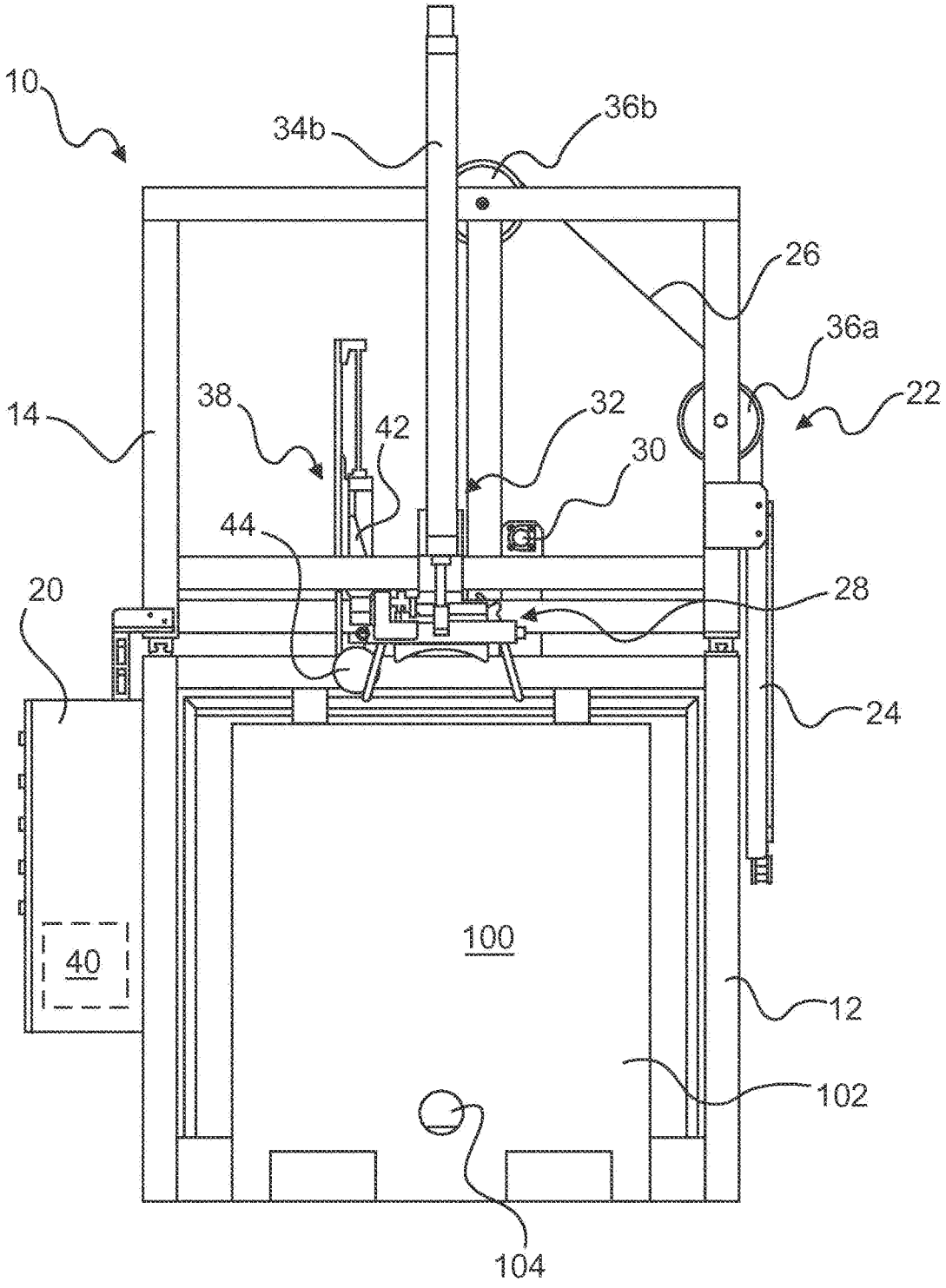
FIG. 2 the apparatus shown in FIG. 1 in a side view.
Figure 3:
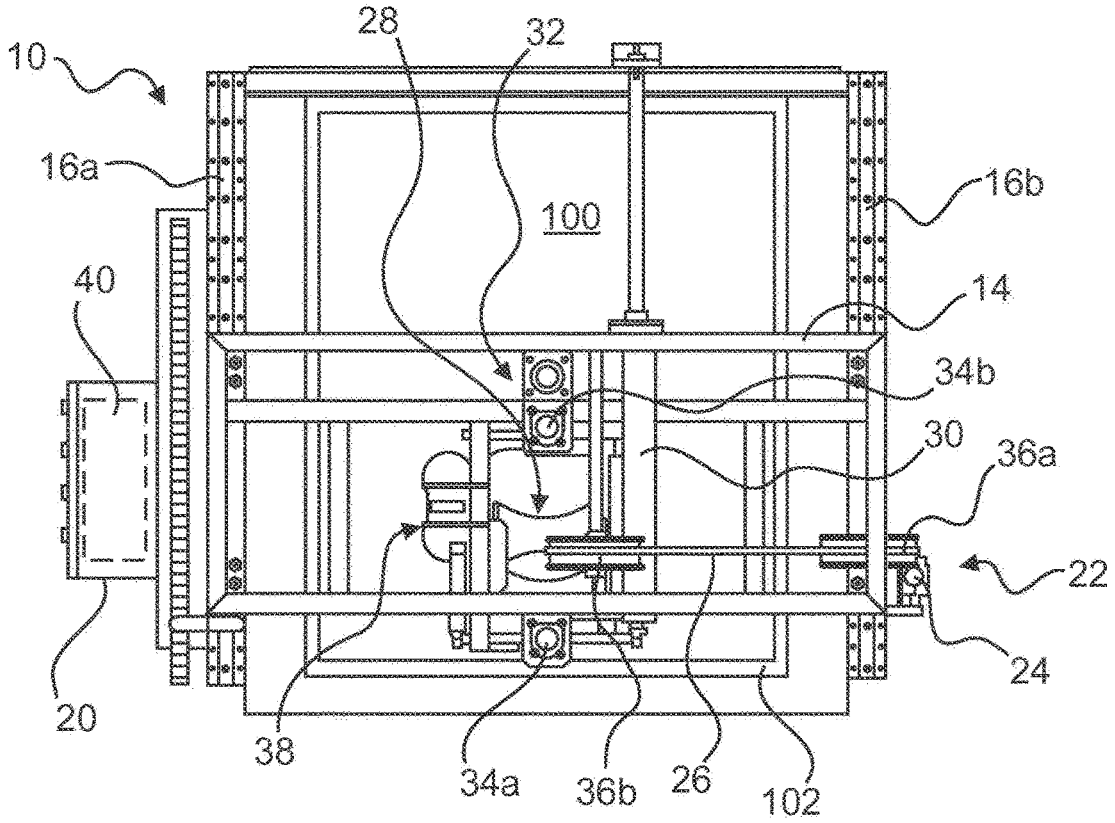
FIG. 3 the apparatus shown in FIG. 1 in a top view.

FIG. 1 to FIG. 3 show an apparatus 10 for emptying a flexible liner 106 of a packaging container. The liner 106, not shown, is positioned within a container 100. The liner 106 to be emptied has an outlet tap that extends through the outlet opening 104 in the side wall 102 of the container 100. A pumping device can be, connected with the outlet tap of the liner 106, by means of which device the flowable material situated in the liner 106 can be pumped out to empty the liner 106. The liner 106 can be configured as a film sack or film bag, for example, and is protected against damage by the container 100. The flowable material situated within the liner 106 can be a fluid, for example, in particular a highly viscous fluid. The apparatus 10 has a base frame 12, onto which a frame structure 14 is set. The frame structure 14 can be displaced in the horizontal direction by way of the rails 16*a*, 16*b*, of the base frame 12. By means of the horizontal displacement of the frame structure 14, the apparatus 10 can be switched from a setup state to a working state, wherein in the setup state of the apparatus 10, the liner 106 can, be positioned in the apparatus 10 in a suitable manner and fastened to it. In the working state of the apparatus 10, emptying of the liner 106 can then take place. The horizontal displacement of the frame structure 14 takes place by way of a drive 30, wherein the drive 30 can be a pneumatic or hydraulic setting cylinder. An appropriate pneumatic pressure or hydraulic pressure can be made available to the apparatus 10 by way of connectors 18. Furthermore, a housing 20 is fastened to the base frame 12, wherein the housing 20 comprises the power supply and the control device 40.

A pulling unit 22 is arranged on the frame structure 14, which unit has a movable pulling element 26 configured as a pulling cable. The pulling element 26 can be fastened onto a fastening section 108 of the liner 106, wherein the fastening section 108 of the liner 106 usually comprises the inlet tap of the liner 106, by way of which the liner 106 was filled with the flowable material. The fastening section 108 of the liner 106 can be pulled up and let down by means of the pulling element 26 of the pulling unit 22, so as to empty the liner 106. For this purpose, the pulling element 26 is connected with the drive 24 of the pulling unit 22, which drive is configured as a setting cylinder. By means of a linear movement of the drive 24, a movement of the pulling element 26 is implemented, wherein pulling up and letting down the liner 106 can be implemented by way of the deflection rollers 36*a*, 36*b*, over which the pulling element 26 runs.

Furthermore, the apparatus 10 comprises a stripping device 28, by means of which the liner 106 can be stripped empty, section by section, during the emptying process. For this purpose, the liner 106 must be inserted into the apparatus 10, before the emptying process, in such a manner that it extends along a stripping region of the stripping device 28, wherein the stripping region can be formed, in particular, by means of a stripping opening 54 of the stripping device 28. The apparatus 10 furthermore comprises a lifting device 32, by means of which the stripping device 28 can be moved in the vertical direction. The lifting device 32 has a non-manual drive 34*a*, 34*b*, which is implemented by means of two setting cylinders that are arranged essentially parallel. The setting cylinders 34*a*, 34*b* can be hydraulic or pneumatic setting cylinders or electric cylinders.

Furthermore, the apparatus 10 comprises a filling level detection device 38, by means of which the filling level of the liner 106 can be detected during emptying of the liner 106. The filling level detection device 38 is also fastened to the lifting device 32, so that both the stripping device 28 and the filling level detection device 38 can be moved in the vertical direction by means of the lifting device 32. The control device 40 of the apparatus 10 is set up for controlling the drive 34*a*, 34*b* of the lifting device 32 as a function of the filling level of the liner 106, as detected by the filling level detection device 38.

Figure 4:
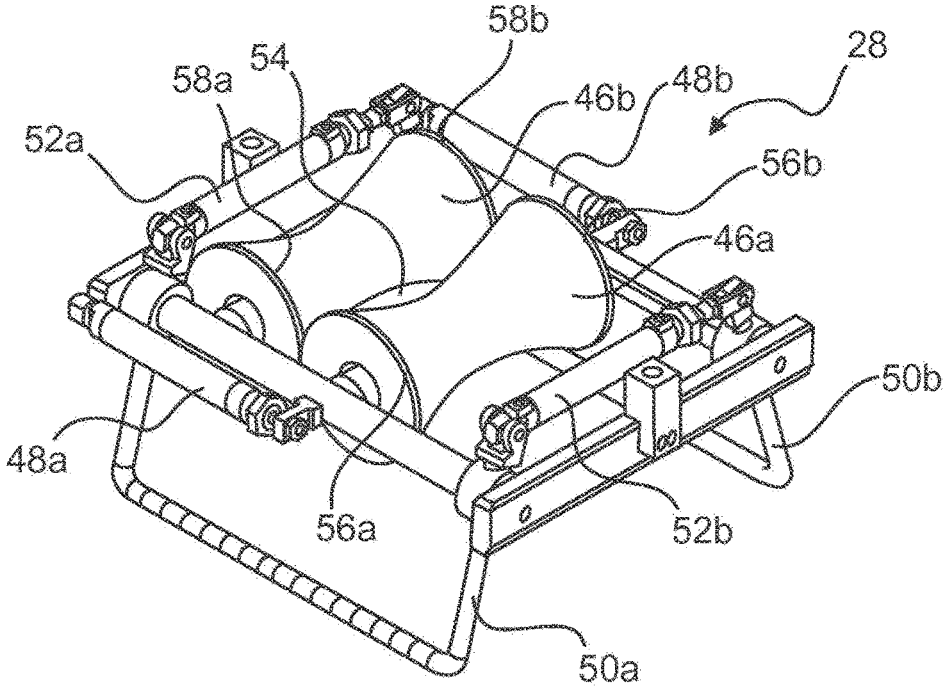
FIG. 4 a stripping device of an apparatus according to the invention in a perspective representation.

FIG. 4 shows a stripping device 28, which serves for stripping the liner 106 during emptying of the liner 106. The stripping device 28 has two stripping bodies 46*a*, 46*b* configured as stripping rollers, which have axes of rotation that are essentially parallel. The stripping bodies 46*a*, 46*b* have a curved outer mantle surface, wherein the cross-section decreases in the direction of the center of the body, in such a manner that a stripping opening 54 forms between the stripping bodies 46*a*, 46*b*. The stripping body 46*a* can be displaced in the horizontal direction by way of the setting cylinders 48*a*, 48*b*. The size of the stripping opening 54 can be changed by means of the displacement of the stripping body 46*a*. During the emptying process, the liner 106 extends through the stripping opening 54, so that the stripping bodies 46*a*, 46*b* strip the liner 106, section by section, during a relative movement of the liner 106 and of the stripping device 28. For positioning of the liner 106 before the emptying process, the stripping body 46*a* is displaced so as to maximize the opening size of the stripping opening 54, so that insertion of the liner 106 is simplified.

Furthermore, the stripping device 28 has two opposite brackets 50*a*, 50*b* arranged below the stripping bodies 46*a*, 46*b*. The brackets 50*a*, 50*b* can be pivoted by way of the setting cylinders 52*a*, 52*b*, wherein the pivot axes of the brackets 50*a*, 50*b* are essentially arranged parallel to one another. The axes of rotation of the stripping bodies 46*a*, 46*b* configured as stripping rollers and the pivot axes of the brackets 50*a*, 50*b* lie in a horizontal plane, wherein the axes of rotation of the stripping bodies 46*a*, 46*b* are arranged at a right angle to the pivot axes of the brackets 50*a*, 50*b*.

The stripping body 46*a* has material ridges 56*a*, 56*b* that run around the outer sides and engage into corresponding circumferential grooves 58*a*, 58*b* of the stripping body 46*b*. By means of the circumferential material ridges 56*a*, 56*b* and the circumferential grooves 58*a*, 58*b*, stabilization of the stripping bodies 46*a*, 46*b* takes place, on the one hand, and on the other hand, in this way reciprocal transfer of rotational movements of a stripping body 46*a*, 46*b* during stripping of the liner 106 is achieved.

Figure 5:
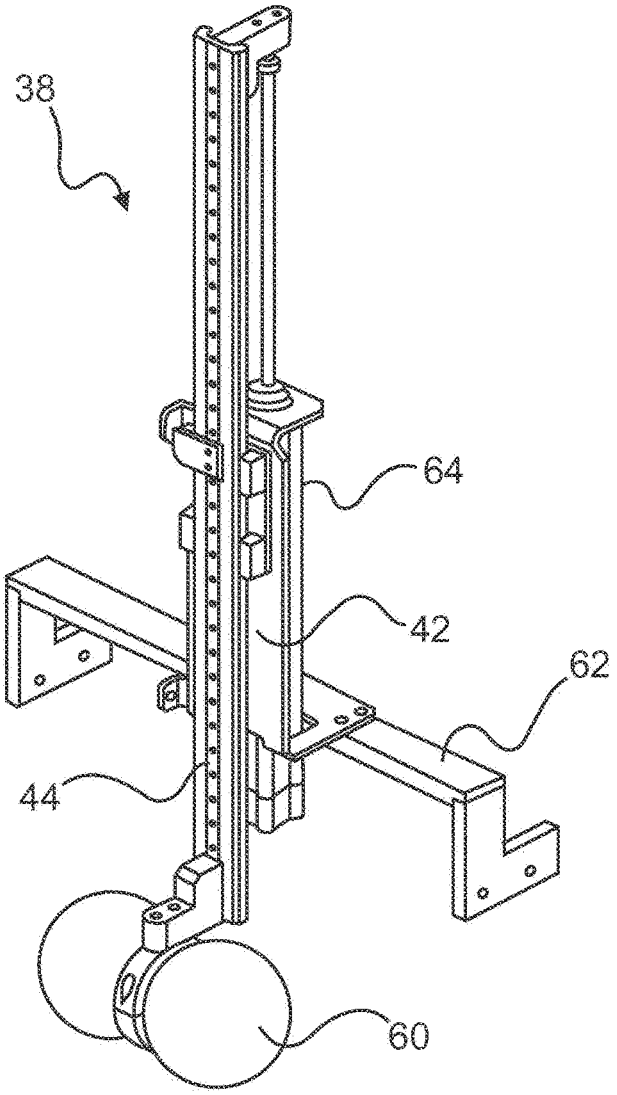
FIG. 5 a filling level detection device of an apparatus according to the invention in a perspective representation.
Figure 6:
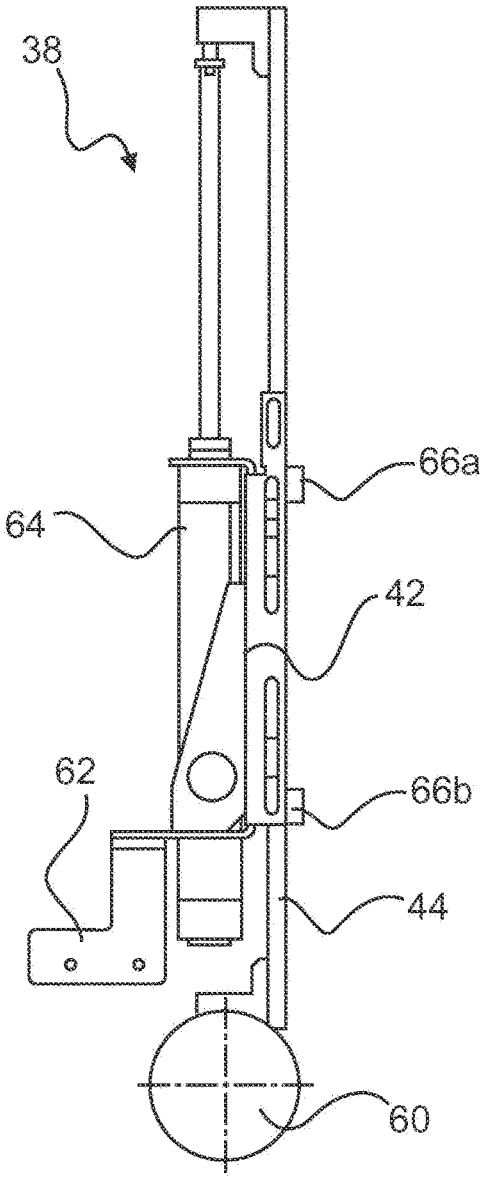
FIG. 6 the filling level detection device shown in FIG. 5 in a side view.

FIG. 5 and FIG. 6 show a filling level detection device 38, by means of which the filling level of the liner 106 can be detected during emptying of the liner. Fastening of the filling level detection device 38 to the lifting device 32 takes place by way of the fastening frame 62. The filling level detection device 38 can thereby be moved in the vertical direction by way of the lifting device 32. A guide 42 is fastened to the fastening frame 62, within which guide a contact device 44 is guided, which can be moved in the vertical direction relative to the guide 42. The contact device 44 has a contact section 60, which is formed by two round bodies. The contact section 60 of the contact device 44 comes into contact with the liner 106 during the downward movement of the lifting device 32, wherein due to the contact with the liner 106 and the further downward movement of the lifting device 32, a relative movement of the contact device 44 and of the guide 42 is brought about. The filling level of the liner 106 can be detected by way of the relative movement of the contact device 44 and of the guide 42. If the path of the relative movement of the contact device 44 and of the guide 42 exceeds a limit value, the downward movement of the lifting device 32 is interrupted, and upward movement of the lifting device 32 is brought about. The relative movement between the contact device 44 and the guide 42 is detected by way of the sensors 66*a*, 66*b*. If a detection section of the contact device 44 reaches the sensor 66*a*, the downward movement of the lifting device 32 is interrupted and upward movement of the lifting device 32 is brought about. If the detection section of the contact device 44 is moved into the detection range of the sensor 66*b*, the upward movement of the lifting device 32 is interrupted and downward movement of the lifting device 32 is brought about.

Furthermore, the contact device 44 can be moved in the vertical direction by means of the setting cylinders 64.

Figure 9:
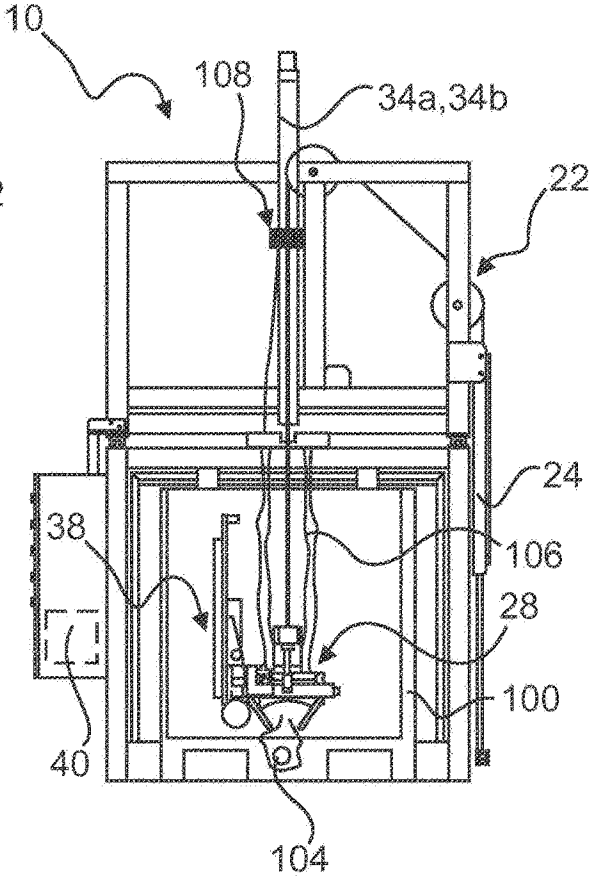
FIG. 9 the apparatus shown in FIG. 7 during emptying of a liner in a third state.
Figure 8:
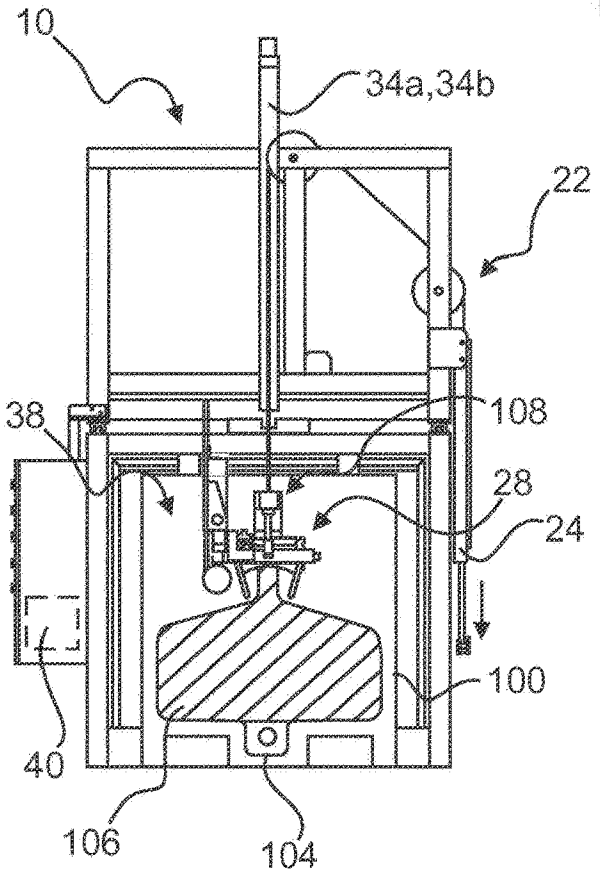
FIG. 8 the apparatus shown in FIG. 7 during emptying of a liner in a second state.
Figure 7:
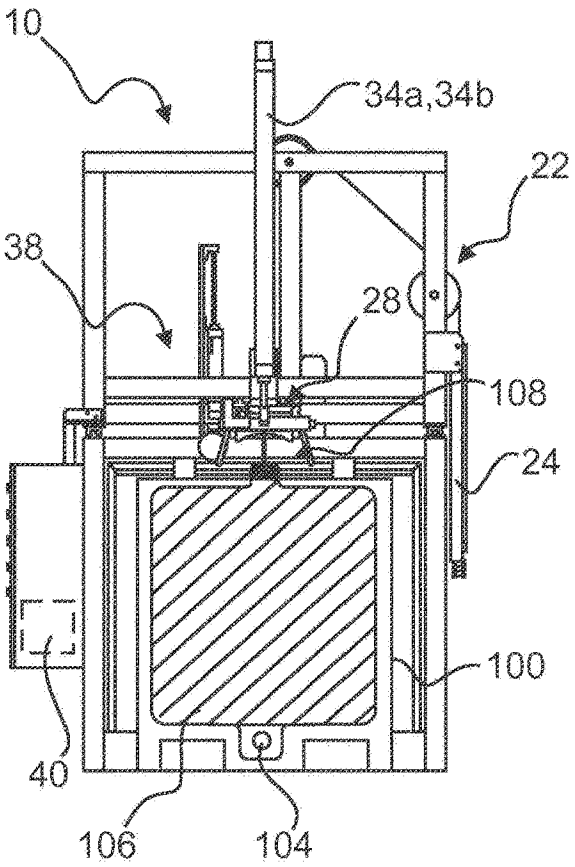
FIG. 7 an exemplary embodiment of the apparatus according to the invention during emptying of a liner in a first state.

FIG. 7 to FIG. 9 show an emptying process of a liner 106 by means of an apparatus 10 set up for emptying the liner 106. The control device 40 of the apparatus 10 shown is set up for controlling the drive 24 of the pulling unit 22 and the drive 34*a*, 34*b* of the lifting device 32. In this regard, the drive 24 of the pulling unit 22 is controlled in such a manner that the fastening section 108 of the liner 106 is constantly kept pulled during emptying of the liner 106. The drive 34*a*, 34*b* of the lifting device 32 takes place in such a manner that the stripping device 28 is automatically moved upward and downward by means of the lifting device 32 during emptying of the liner 106 multiple times, one after the other. This also results in the fastening section 108 of the liner 106 being pulled up and let down multiple times by means of the pulling unit 22. Pulling up and letting down the fastening section 108 of the liner 106, and the upward and downward movements of the stripping device 28 are specifically coordinated with one another, in that the fastening section 108 of the liner 106 is constantly kept pulled during emptying of the liner 106, on the one hand, and on the other hand letting down the fastening section 108 of the liner 106 is implemented, so as to prevent a pulling force limit value from being exceeded if an increase in pulling force results from the downward movement of the stripping device 28.

The control device controls the drive 24 of the pulling unit 22 and the drive 34*a*, 34*b* of the lifting device 32 in such a manner that pulling up the fastening section 108 of the liner 106 and moving the stripping device 28 downward, brought about by means of the lifting device 32, is prevented from occurring simultaneously during emptying of the liner. Furthermore, control of the drive 24 of the pulling unit 22 and of the drive 34*a*, 34*b* of the lifting device 32 takes place in such a manner that letting down the fastening section 108 of the liner 106 and the upward movement of the stripping device 28, brought about by means of the lifting device 32, is prevented from occurring simultaneously during emptying of the liner 106.

Furthermore, the drive 24 of the pulling unit 22 and the drive 34*a*, 34*b* of the lifting device 32 are controlled in such a manner that pulling up the fastening section 108 of the liner 106 takes place simultaneously with the upward movement of the stripping device, brought about by means of the lifting device 32, during emptying of the liner 106. Furthermore, letting down the fastening section 108 of the liner 106 takes place simultaneously with the downward movement of the stripping device 28, brought about by means of the lifting device 32, during emptying of the liner 106. The pulling path when pulling up the fastening section 108 of the liner 106 and the lift path of the upward movement of the stripping device 28 differ from one another multiple times during the emptying process. Furthermore, the release path when letting down the fastening section 108 of the liner 106 and the lift path of the downward movement of the stripping device 28 differ from one another multiple times during the emptying process.

Between the states shown in FIG. 7 and FIG. 8, the fastening section 108 of the liner 106 was pulled up and let down multiple times by means of the pulling unit 22. Furthermore, the stripping device 28 moved upward in the vertical direction multiple times, and subsequently moved downward again in the vertical direction multiple times. Consequently, multiple stripping cycles and therefore also multiple pull-up cycles lie between the states shown in FIG. 7 and FIG. 8.

Likewise, the fastening section 108 of the liner 106 was pulled up and let down multiple times by means of the pulling unit 22, between the states shown in FIG. 8 and FIG. 9. Furthermore, the stripping device 28 was moved upward in the vertical direction multiple times, and subsequently moved downward again in the vertical direction. Consequently, multiple stripping cycles and therefore also multiple pull-up cycles lie between the states shown in FIG. 8 and FIG. 9.

REFERENCE SYMBOLS

10 apparatus
12 base frame
14 frame structure
16*a*, 16*b* rails
18 connectors
20 housing
22 pulling unit
24 drive
26 pulling element
28 stripping device
30 drive
32 lifting device
34*a*, 34*b* drive
36*a*, 36*b* deflection rollers
38 filling level detection device
40 control device
42 guide
44 contact device
46*a*, 46*b* stripping bodies
48*a*, 48*b* setting cylinders
50*a*, 50*b* bracket(s)
52*a*, 52*b* setting cylinders
54 stripping opening
56*a*, 56*b* material ridge
58*a*, 58*b* grooves
60 contact section
62 fastening frame
64 setting cylinders
66*a*, 66*b* sensors
100 container
102 side wall
104 outlet opening
106 liner
108 fastening section

What is claimed is:

1. An apparatus for emptying a flexible liner of a packaging container, the apparatus comprising:

a pulling unit comprising a movable pulling element, a fastening section of the liner fastened to the movable pulling element, wherein the fastening section of the liner can be pulled up and let down by the pulling element of the pulling unit to empty the liner;

a stripping device comprising one or more stripping bodies for stripping a section of the liner to empty the liner;

a lifting device for moving the stripping device in the vertical direction; and a control device for controlling the drive of the pulling unit or the drive of the lifting device independent of one another;

wherein the control device is set up for controlling the drive of the lifting device in such a manner that the stripping device is automatically moved upward and downward by means of the lifting device during emptying of the liner;

wherein the control device is set up for controlling the drive of the pulling unit and the drive of the lifting device in such a manner that (i) simultaneously pulling up the fastening section of the liner and downward movement of the stripping device, brought about by the lifting device, or (ii) simultaneously letting down the fastening section of the liner and upward movement of the stripping device, brought about by the lifting device, is prevented during emptying of the liner.

2. An apparatus for emptying a flexible liner of a packaging container, the apparatus comprising:

a pulling unit comprising a movable pulling element, a fastening section of the liner fastened to the movable pulling element, wherein the fastening section of the liner can be pulled up and let down by the pulling element of the pulling unit to empty the liner;

a stripping device comprising one or more stripping bodies for stripping a section of the liner to empty the liner; and a lifting device for moving the stripping device in the vertical direction;

wherein the pulling unit comprises a non-manual drive, the non-manual drive for moving the pulling element to pull up and let down the fastening section of the liner;

further comprising a control device for controlling the drive of the pulling unit or the drive of the lifting device independent of one another, wherein the control device is set up for controlling the drive of the lifting device in such a manner that the stripping device is automatically moved upward and downward by means of the lifting device during emptying of the liner;

wherein the control device is set up for controlling the drive of the pulling unit and the drive of the lifting device in such a manner that (i) pulling up the fastening section of the liner simultaneously with the upward movement of the stripping device, brought about by means of the lifting device, or (ii) letting down the fastening section of the liner simultaneously with the downward movement of the stripping device, brought about by means of the lifting device, takes place during emptying of the liner.

3. An apparatus for emptying a flexible liner of a packaging container, the apparatus comprising:

a pulling unit comprising a movable pulling element, a fastening section of the liner fastened to the movable pulling element, wherein the fastening section of the liner can be pulled up and let down by the pulling element of the pulling unit to empty the liner;

a stripping device comprising one or more stripping bodies for stripping a section of the liner to empty the liner; and a lifting device for moving the stripping device in the vertical direction;

a filling level detection device, which is set up for detecting the filling level of the liner during emptying of the liner;

wherein the filling level detection device has a guide fastened to the lifting device, in locally fixed manner, and a contact device guided within the guide, which can be moved in the vertical direction relative to the guide, wherein a contact section of the contact device is set up for coming into contact with the liner during the downward movement of the lifting device, wherein as a result of the contact with the liner and of the further downward movement of the lifting device, a relative movement of the contact device and of the guide is brought about.

* * * * *